US007065911B2

(12) United States Patent
Silva

(10) Patent No.: US 7,065,911 B2
(45) Date of Patent: Jun. 27, 2006

(54) APPARATUS FORMED FROM RECYCLED TIRE MATERIALS

(76) Inventor: Phillip G. Silva, P.O. Box 302, Wilseyville, CA (US) 95257

( * ) Notice: Subject to any disclaimer, the term of this patent is extended or adjusted under 35 U.S.C. 154(b) by 135 days.

(21) Appl. No.: 10/804,009

(22) Filed: Mar. 19, 2004

(65) Prior Publication Data

US 2005/0208264 A1 Sep. 22, 2005

(51) Int. Cl.
*G09F 15/00* (2006.01)

(52) U.S. Cl. ..... 40/610; 40/612; 428/99; 428/903.3; 248/548; 248/900

(58) Field of Classification Search ..... 428/99, 428/903.3, 122; 52/DIG. 9; 248/548, 900; 264/912; 40/610, 612
See application file for complete search history.

(56) References Cited

U.S. PATENT DOCUMENTS 4,028,288 A 6/1977 Turner
5,246,754 A 9/1993 Miller
5,292,467 A * 3/1994 Mandish et al. ..... 264/112
5,472,750 A 12/1995 Miller
5,714,219 A 2/1998 Mashunkashey
6,017,472 A 1/2000 Mack et al.
6,244,014 B1 * 6/2001 Barmakian ..... 52/736.3
6,322,863 B1 * 11/2001 Kubicky ..... 428/34.5
6,390,436 B1 * 5/2002 Barnes et al. ..... 248/548

* cited by examiner

*Primary Examiner*—Alexander S. Thomas

(57) ABSTRACT

An apparatus includes an elongated body formed from recycled tire material. At least one reinforcing member extends within the body and is disposed between opposed end portions thereof. Such a reinforcing member is preferably positioned substantially parallel to a longitudinal axis and may have a substantially V-shape, a substantially U-shape or a substantially cylindrical shape, for example. The apparatus further includes a connecting mechanism for removably connecting select ones of the opposed end portions thereof to a support surface or an object, for example.

6 Claims, 2 Drawing Sheets

APPARATUS FORMED FROM RECYCLED TIRE MATERIALS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable

BACKGROUND OF THE INVENTION

1. Technical Field

This invention relates to tires and, more particularly, to support structures formed from recycled tires and reinforced with steel members.

2. Prior Art

The accumulation of old tires and waste resin products and containers have long presented an ecological problem with the non-biodegradable characteristic of such waste. Landfill area is rapidly disappearing, and many areas prohibit the burying of this type of waste, as well as the burning thereof.

Accordingly, used tires heretofore devised and utilized have been shredded and recycled to help reduce the cumulating of same in landfills. The very toughness that makes old tire carcasses a difficult disposal problem lends strength and durability to the unique posts, poles, beams, stakes and supports formed from such recycled material. Unfortunately, no known prior art teaches such posts, for example, as being made from steel-reinforced materials in combination with the recycled tire materials.

Accordingly, a need remains for support structures that overcome such noted shortcomings.

BRIEF SUMMARY OF THE INVENTION

In view of the foregoing background, it is therefore an object of the present invention to provide reinforced support posts formed from recycled tire material and steel beams that can be used as sign posts for highways, railroad ties, boat hulls, and racetrack walls, for example. These and other objects, features, and advantages of the invention are provided by an apparatus including an elongate body formed from recycled tire material. The body has a plurality of sidewalls and oppositely disposed end portions integral with the plurality of sidewalls, which define a length of the body therebetween. The body also has a centrally disposed longitudinal axis.

At least one reinforcing member extends within the body and is disposed between the opposed end portions, between the plurality of sidewalls thereof. The at least one reinforcing member is preferably positioned substantially parallel to the longitudinal axis of the body. Such an at least one reinforcing member may be formed to have a substantially V-shaped cross-section, a substantially U-shaped cross-section, a substantially helical shape or a substantially cylindrical shape, for example. Of course, it should be understood the reinforcing member may employ various cross-sections such as an I-beam and square-shaped cross-section, as well know to a person of ordinary skill in the art.

The present invention may further include a connecting mechanism for removably connecting select ones of the opposed end portions to a support surface, for example. The connecting mechanism includes a plurality of brackets having a plurality of apertures formed therein and for receiving a plurality of fastening members therethrough. One of the plurality of brackets is preferably secured to the apparatus and another one of the plurality of brackets is preferably secured to a ground surface. Such a plurality of brackets are pivotally connected and selectively adjustable along a select quadrant so that the apparatus can be supported along a non-planar terrain.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
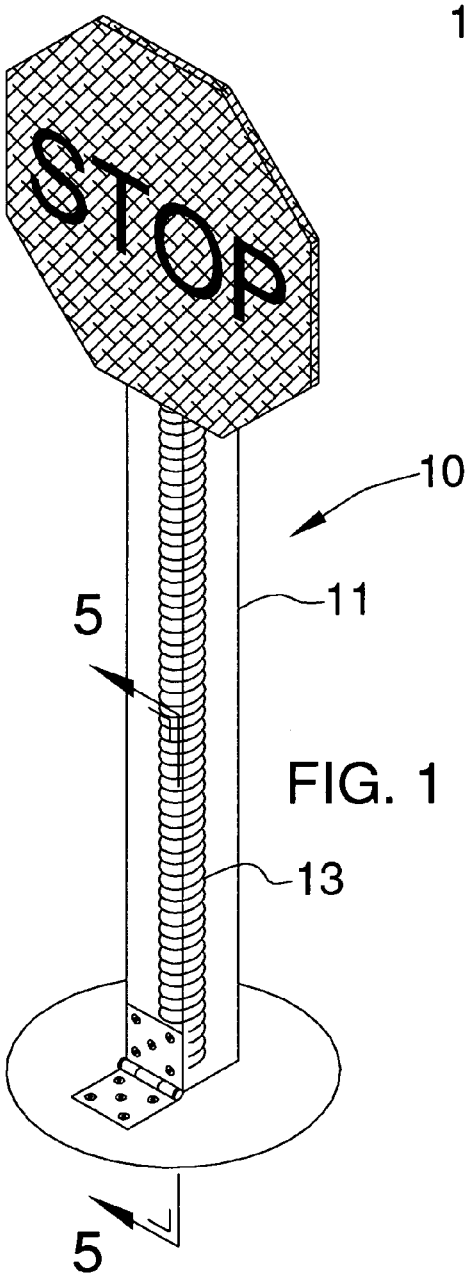
FIG. 1 is a perspective view showing a reinforced apparatus formed from recycled tires and in a preferred environment, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout. Prime and double prime notations refer to alternate embodiment of similar elements.

The apparatus of this invention is referred to generally in FIGS. 1–5 by the reference numeral 10 and is intended to provide reinforced support structures such as posts, for example, that are made from recycled tires. It should be understood that the present invention may be used in a variety of industries such as the automobile, railroad and boating industries, for example.

The apparatus 10 includes a body 11 having a plurality of sidewalls integral with each other and defining a generally rectangular shape. The sidewalls of body 11 are substantially planner with opposed end portions defining a length of the apparatus 10. A conventional stop sign is connected to a top end portion of apparatus 10 for illustrative purposes.

Figure 2:
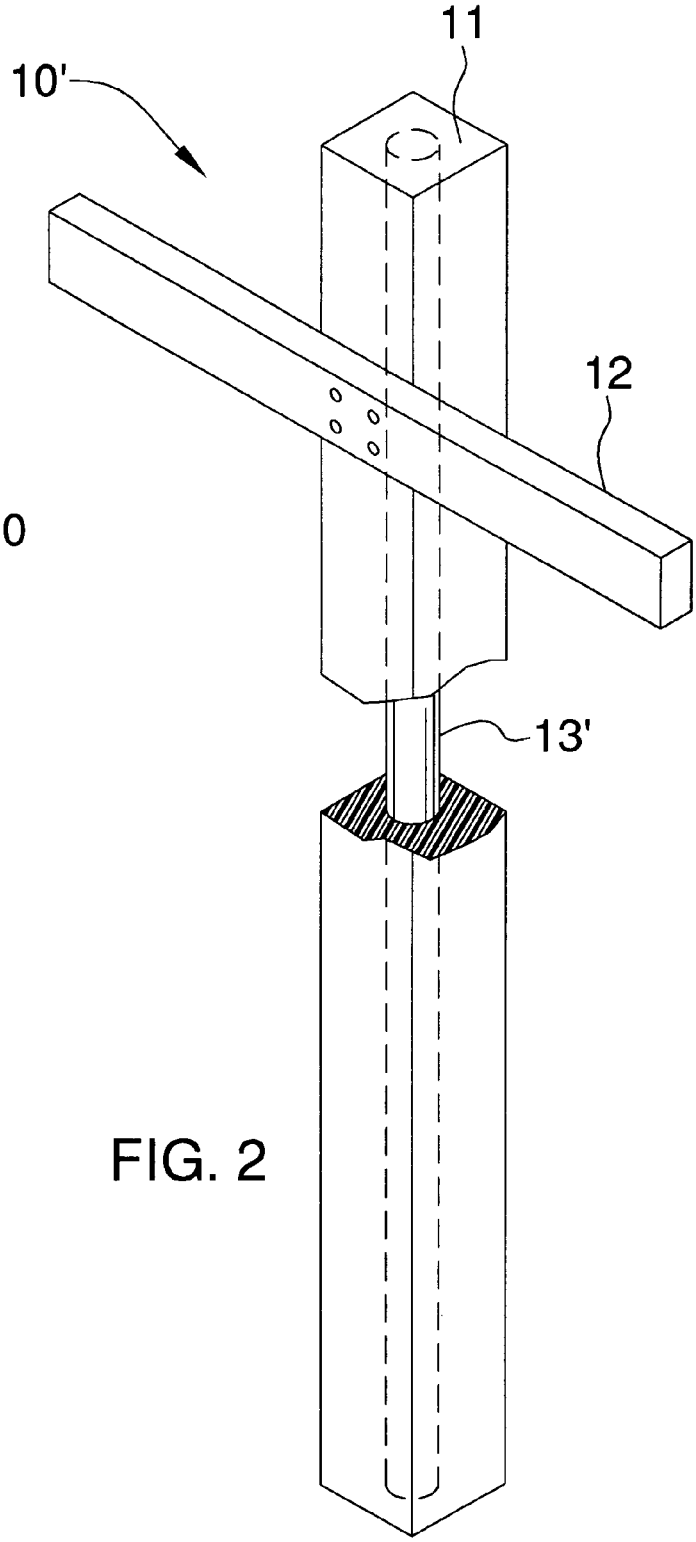
FIG. 2 is a partially enlarged view showing an alternate embodiment of the reinforcing member FIG. 1.

As best shown in FIG. 2, apparatus 10' shows an alternate embodiment of the present invention wherein a body 11' has a substantially square cross-section. A cross-member 12 is secured to a sidewall of apparatus 10' and extends substantially perpendicular thereto. Of course, a conventional plastic or rubber coating may be applied to the sidewalls of the present invention for protecting same from harsh environmental elements, as well know to a person of ordinary skill in the art.

Figure 3:
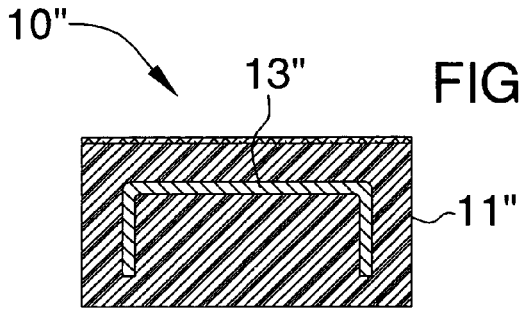
FIG. 3 is an enlarged cross-sectional view showing yet another embodiment of the reinforcing member.

Now referring to FIG. 3, the cross-section of apparatus 10" has a substantially rectangular shape and includes a reinforcing member 13" disposed in the body 11". In particular, the reinforcing member 13" has a substantially U-shape and extends between the opposed end portions of body 11". Such a reinforcing member 13" is also spaced within the sidewalls of the body 11", as perhaps better shown in FIG. 4. The reinforcing member 13" provides added support and strength to the body 11" of apparatus 10" and may be formed from conventional steel, as well known in the art.

Figure 4:
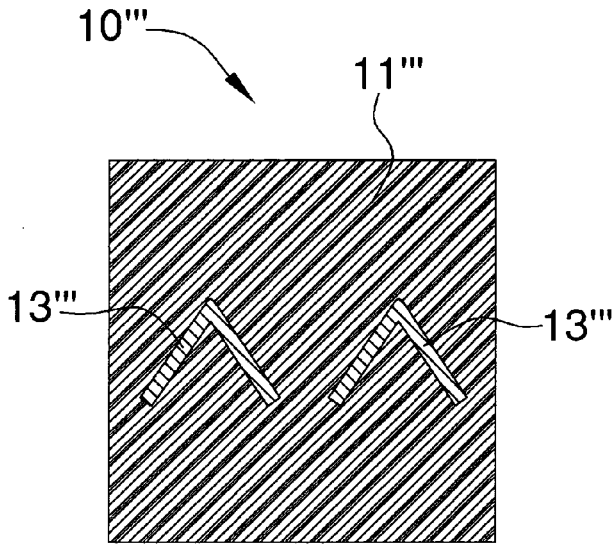
FIG. 4 is an enlarged cross-sectional view showing yet another embodiment of the reinforcing member.

Now referring to FIG. 4, a cross-section of apparatus 10''' is shown wherein its body 11''' includes a plurality of reinforcing members 13'''. Such reinforcing members are spaced apart generally medially within the square cross-section of body 11'''. In particular, reinforcing members 13''' are formed to have a substantially V-shape and extend along the length of apparatus 10''' and generally between its opposed end portions.

Figure 5:
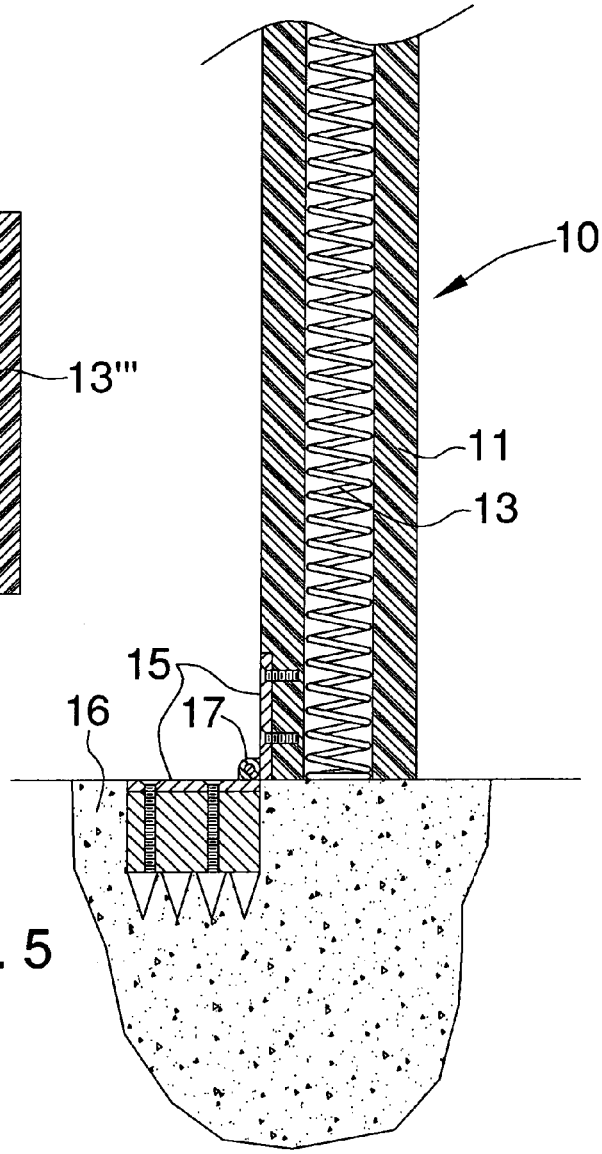
FIG. 5 is an enlarged, partial cross-sectional view of FIG. 1, taken along line 5—5.

FIG. 5 illustrates a cross-sectional view of the preferred embodiment 10 wherein a plurality of brackets 15 are pivotally connected to each other via a hinge member 17 and respectively secured to the apparatus 10 and a support surface such as the ground 16, for example. Such a plurality of brackets 15 may be pivoted within a selected quadrant so that the apparatus 10 can be selectively maintained along a vertical plane or offset therefrom, as needed. The reinforcing member 13 notably has a spring-like helical shape for providing compressive resistance along the vertical axis, as well known to a person of ordinary skill in the art.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. An apparatus comprising:

an elongate body formed from recycled tire material, said body having a plurality of sidewalls and oppositely disposed end portions integral with said plurality of sidewalls and defining a length of said body therebetween, said body having a centrally disposed longitudinal axis;

at least one reinforcing member extending within said body and disposed between said opposed end portions and said plurality of sidewalls thereof, said at least one reinforcing member positioned parallel to the longitudinal axis;

connecting means for removably connecting select ones of said opposed end portions to an object; and an octagonal stop sign connected to said body for warning vehicles and pedestrians of oncoming traffic;

wherein said connecting means comprises: a plurality of brackets having a plurality of apertures formed therein and for receiving a plurality of fastening members therethrough;

wherein one said plurality of brackets is secured to said apparatus and another said plurality of brackets is secured to a ground surface, said plurality of brackets being pivotally connected and selectively adjustable along a select quadrant such that said first and second brackets are oriented orthogonal to each other when said body is vertically situated, said second bracket having an anchoring member directly attached to a bottom surface thereof and seated below the ground surface, said anchoring member having a plurality of spikes directly connected thereto and protruding vertically downwardly, said anchoring member having a thickness greater than a thickness of said first and second brackets.

2. The apparatus of claim 1, wherein said at least one reinforcing member comprises: first and second V-shaped reinforcing members juxtaposed side-by-side within said body and equidistantly centered from said sidewalls.

3. The apparatus of claim 1, wherein said at least one reinforcing member is formed to have a U-shaped cross-section.

4. The apparatus of claim 1, wherein said at least one reinforcing member is formed to have a generally V-shaped cross-section.

5. The apparatus of claim 1, wherein said at least one reinforcing member is formed to have a cylindrical shape.

6. The apparatus of claim 1, wherein said at least one reinforcing member is formed to have a helical shape.

* * * * *